US010600353B2

(12) United States Patent
Xi et al.

(10) Patent No.: US 10,600,353 B2
(45) Date of Patent: Mar. 24, 2020

(54) METHOD FOR DRIVING A PIXEL CIRCUIT, DISPLAY PANEL AND DISPLAY DEVICE

(71) Applicant: SHANGHAI TIANMA AM-OLED CO., LTD., Shanghai (CN)

(72) Inventors: Kerui Xi, Shanghai (CN); Tingting Cui, Shanghai (CN); Baiquan Lin, Shanghai (CN); Junting Ouyang, Shanghai (CN); Zhonglan Cai, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 48 days.

(21) Appl. No.: 15/912,045

(22) Filed: Mar. 5, 2018

(65) Prior Publication Data

US 2018/0197458 A1 Jul. 12, 2018

(30) Foreign Application Priority Data

Sep. 30, 2017 (CN) ..... 2017 1 0937938

(51) Int. Cl.
*G09G 3/30* (2006.01)
*G09G 3/3233* (2016.01)

(52) U.S. Cl.
CPC ..... *G09G 3/30* (2013.01); *G09G 3/3233* (2013.01); *G09G 2300/0819* (2013.01); *G09G 2300/0842* (2013.01); *G09G 2300/0861* (2013.01); *G09G 2310/0251* (2013.01); *G09G 2310/0262* (2013.01); *G09G 2310/0264* (2013.01); *G09G 2320/043* (2013.01)

(58) Field of Classification Search
CPC ... G09G 2300/0819; G09G 2300/0842; G09G 2310/0262; G09G 2310/0272; G09G 2310/0289; G09G 2310/08; G09G 2320/0214; G09G 2320/0233; G09G 2320/0238; G09G 3/3233; G09G 3/3266; G09G 3/3275; H01L 27/3276
See application file for complete search history.

(56) References Cited

U.S. PATENT DOCUMENTS 7,414,599 B2 * 8/2008 Chung ..... G09G 3/3233 315/169.3
8,018,408 B2 * 9/2011 Choi ..... G09G 3/3233 345/76

(Continued)

FOREIGN PATENT DOCUMENTS

CN 1577453 A 2/2005
CN 102349098 A 2/2012

*Primary Examiner* — Michael J Jansen, II
(74) *Attorney, Agent, or Firm* — Alston & Bird LLP

(57) ABSTRACT

Disclosed are a method for driving a pixel circuit, a display panel and a display device. The pixel circuit includes: a data write module, a drive transistor, a hold module and a light-emitting element. The method comprises, in a time period for a frame of display: a data writing stage in which a data signal is written by the data write module into a gate electrode of the drive transistor; a light-emitting stage in which a voltage on the gate electrode of the drive transistor is held by the hold module, the drive transistor supplies a drive current to the light-emitting element, and the light-emitting element emits light in response to the drive current; and a cut-off stage in which the drive transistor operates in a full cut-off region.

17 Claims, 9 Drawing Sheets

(56) References Cited

U.S. PATENT DOCUMENTS 8,237,637 B2 * 8/2012 Chung ..... G09G 3/3233 345/76
8,994,619 B2 * 3/2015 Jeong ..... G09G 3/3233 345/76
9,224,972 B2 * 12/2015 Shin ..... H05B 33/0803
9,330,602 B2 * 5/2016 Tanikame ..... G09G 3/3233
9,489,894 B2 * 11/2016 Yin ..... G09G 3/3233
9,659,529 B2 * 5/2017 Tanikame ..... G09G 3/3233
9,734,762 B2 * 8/2017 Kishi ..... G09G 3/3225
9,748,321 B2 * 8/2017 Kim ..... H01L 27/3262
9,922,599 B2 * 3/2018 Li ..... G09G 3/3291
9,972,242 B2 * 5/2018 Lim ..... G09G 3/3233
10,026,361 B2 * 7/2018 Ho ..... G09G 3/3266
10,192,489 B1 * 1/2019 Liu ..... G09G 3/3258
2005/0017934 A1 * 1/2005 Chung ..... G09G 3/3233 345/82
2008/0150844 A1 * 6/2008 Choi ..... G09G 3/3233 345/76
2008/0150846 A1 * 6/2008 Chung ..... G09G 3/3233 345/80
2012/0147060 A1 * 6/2012 Jeong ..... G09G 3/3233 345/690
2014/0070184 A1 * 3/2014 Shin ..... H05B 33/0803 257/40
2014/0340377 A1 * 11/2014 Kishi ..... G09G 3/3225 345/211
2015/0221256 A1 * 8/2015 Tanikame ..... G09G 3/3233 345/76
2015/0287360 A1 * 10/2015 Yin ..... G09G 3/3233 345/690
2016/0217742 A1 * 7/2016 Tanikame ..... G09G 3/3233
2016/0314746 A1 * 10/2016 Ho ..... G09G 3/3266
2016/0372037 A1 * 12/2016 Lim ..... G09G 3/3233
2017/0011687 A1 * 1/2017 Li ..... G09G 3/3291
2017/0033171 A1 * 2/2017 Kim ..... H01L 27/3262
2018/0226459 A1 * 8/2018 Bae ..... H01L 27/3246
2019/0035332 A1 * 1/2019 Liu ..... G09G 3/3258

* cited by examiner

METHOD FOR DRIVING A PIXEL CIRCUIT, DISPLAY PANEL AND DISPLAY DEVICE

CROSS-REFERENCE TO RELATED APPLICATIONS

This application claims priority to Chinese Patent Application No. CN201710937938.X, filed on Sep. 30, 2017 and entitled "METHOD FOR DRIVING A PIXEL CIRCUIT, DISPLAY PANEL AND DISPLAY DEVICE", the disclosure of which is incorporated herein by reference in its entirety.

TECHNICAL FIELD

The present disclosure relates to display technologies, and in particular, to a method for driving a pixel circuit, a display panel and a display device.

BACKGROUND

In comparison with liquid crystal displays, the organic light-emitting diodes of organic light-emitting displays have the advantages of low power consumption, low production cost, self-luminescence, wide visual angle and fast response speed, etc., and hence currently are widely applied in the display fields of mobile phones, PDAs, digital cameras and the like. Each pixel of the organic light-emitting display includes an organic light-emitting diode and a pixel circuit for driving the organic light-emitting diode to emit light for display.

A pixel circuit generally includes a drive transistor, a plurality of switch transistors and storage capacitors. Due to the manufacture process and device ageing, etc., the characteristics of the drive transistor in the pixel circuit corresponding to the pixel may drift, for example, the threshold voltage may drift. Moreover, the drive transistor usually operates in a subthreshold region for a long time, which also tends to cause the characteristics of the drive transistor to drift. After the characteristics of the drive transistor drift, the characteristic curve will be twisted. The coincidence may not be completely realized even after a compensation, and thus the degrees of characteristic drifts for different drive transistors will be different, causing display mura and artifact, etc., so that the display effect of the whole image may be affected.

SUMMARY

Embodiments of the present disclosure provide a method for driving a pixel circuit, thereby lowering the drift on characteristics of a drive transistor in a pixel circuit, improving the coincidence degree after a compensation, lowering the display mura and artifact, and improving the display effect.

In a first aspect, embodiments of the disclosure provide a method for driving for a pixel circuit, wherein the pixel circuit comprises: a data write module, a drive transistor, a hold module and a light-emitting element. The method for driving includes, in a time period for a frame of display, a data writing stage in which a data signal is written by the data write module into a gate electrode of the drive transistor; a light-emitting stage in which a voltage on the gate electrode of the drive transistor is held by the hold module, the drive transistor supplies a drive current to the light-emitting element, and the light-emitting element emits light in response to the drive current; a cut-off stage in which the drive transistor operates in a full cut-off region.

In a second aspect, embodiments of the disclosure provide a display panel, wherein the display panel comprises pixel circuits arranged in an array, and the pixel circuits includes a data write module, a drive transistor, a hold module and a light-emitting element. The display panel includes: a cut-off voltage generating module, configured to generate a cut-off voltage and transmit the cut-off voltage to a gate electrode of the drive transistor, so as to control the drive transistor to operate in a full cut-off region; a scan signal generating module, configured to output the generated scan signal to a scan line in order to control the data write module to be turned on; a data signal generating module configured to generate a data signal corresponding to the image signal and output the data signal to a data line so that the data signal on the data line is written into the gate electrode of the drive transistor through the turned-on data write module, in order to control the drive transistor to supply a drive current to the light-emitting element so as to drive the light-emitting element to emit light.

In a third aspect, embodiments of the disclosure provide a display device, which comprises the pixel panel according to any of the embodiments of the disclosure.

DETAILED DESCRIPTION

The application will be illustrated in detail in conjunction with the drawings and embodiments. It may be understood that, the embodiments described here are only set for explaining, rather than limiting, the application. Additionally, it further needs to be noted that, for convenient description, the drawings only show the parts related to the application, rather than the whole structure.

Figure 1:
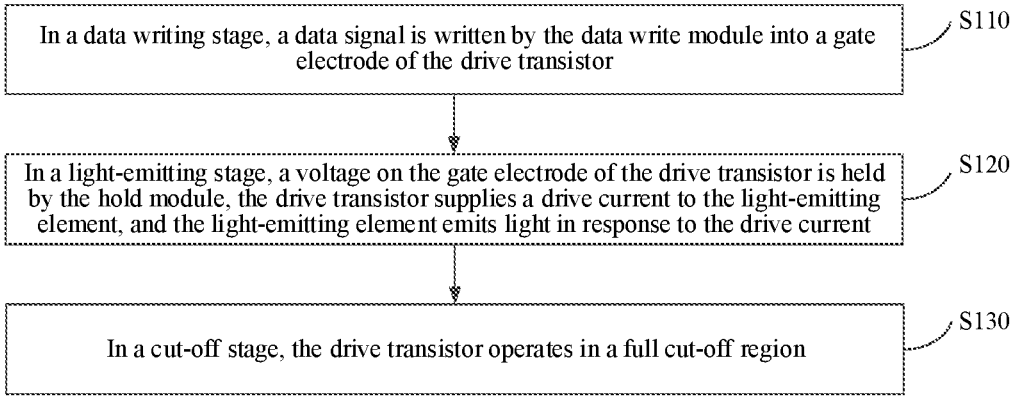
FIG. 1 is a schematic flow chart oft the method for driving a pixel circuit according to an embodiment of the disclosure.

FIG. 1 is a schematic flow chart of a method for driving a pixel circuit according to an embodiment of the disclosure. The pixel circuit includes: a data write module, a drive transistor, a hold module and a light-emitting element.

Referring to FIG. 1, the method includes, in a time period for a frame of display, the following stages:

a data writing stage S110 in which a data signal is written by the data write module into a gate electrode of the drive transistor;

a light-emitting stage S120 in which a voltage on the gate electrode of the drive transistor is held by the hold module, the drive transistor supplies a drive current to the light-emitting element, and the light-emitting element emits light in response to the drive current; and a cut-off stage S130 in which the drive transistor operates in a full cut-off region.

In the data writing stage, a data signal is written by the data write module into a gate electrode of the drive transistor. In the light-emitting stage, the drive transistor generates a corresponding drive current according to a voltage on the data signal written into the gate electrode of the drive transistor, and hence the light-emitting element is driven by the drive current to emit light. At this time, voltage on the gate electrode of the drive transistor is held by the hold module, and the drive transistor continuously generates a drive current to drive the light-emitting element to continuously emit light. In the data writing stage and the light-emitting stage, generally the drive transistor operates in the sub-threshold region. In the cut-off stage, the drive transistor is controlled to operate in a full cut-off region. The drive transistor may be an N-type transistor or a P-type transistor. If the drive transistor is an N-type transistor, and the drive transistor is intended to be controlled to operate in a full cut-off region, then the voltage difference between the gate electrode and the source electrode of the drive transistor needs to be smaller than the negative value of the threshold voltage thereof. If the drive transistor is a P-type transistor, and the drive transistor is intended to be controlled to operate in a full cut-off region, then the voltage difference between the gate electrode and the source electrode of the drive transistor needs to be larger than the negative value of the threshold voltage thereof. For example, for a P-type drive transistor with a threshold voltage of −3.527V, if the drive transistor is needed to operate in a full cut-off region, then the voltage difference between the gate electrode and the source electrode of the drive transistor may be 4V.

Figure 2:
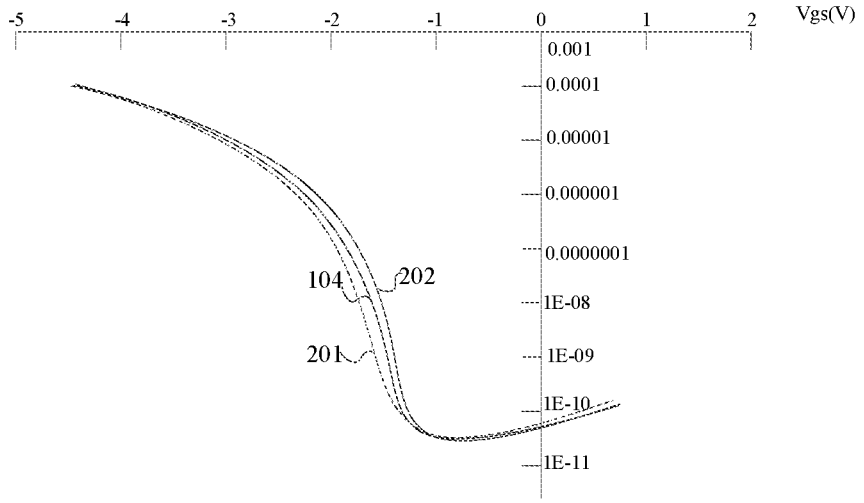
FIG. 2 is a contrast chart of characteristic curves of a drive transistor according to an embodiment of the disclosure.

By the technical solution of the embodiments of the disclosure, because in the cut-off stage, the drive transistor operates in a full cut-off region, that is, during a time period for a frame of display, the drive transistor operates in a full cut-off region in a part of the time period (corresponding to the cut-off stage), so that the magnitude of voltage bias of the drive transistor is relatively low, and thus the drift on characteristics of the drive transistor may be lowered, thereby lowering the degree of twist of the characteristic curve, lowering the display mura and artifact, and improving the display effect of the picture. In one embodiment, referring to FIG. 2, FIG. 2 is a contrast chart of characteristic curves of a drive transistor according to an embodiment of the disclosure. The first characteristic curve 201 represents the original characteristic curve of the drive transistor, the second characteristic curve 202 represents the characteristic curve of the drive transistor after the characteristic drifts, and the third characteristic curve 203 represents the characteristic curve of the drive transistor when it operates in a full cut-off region in a part of the time period (i.e., a cut-off stage). It may be seen that, after the drive transistor operates in a full cut-off region in a part of the time period, the drift on characteristics of the third characteristic curve 203 is somewhat lowered compared to the drift on characteristics of the second characteristic curve 202. That is, when the drive transistor operates in a full cut-off region in a part of the time period, the drift on characteristics of the drive transistor may be lowered, thereby improving the display effect of the picture.

It should be noted that in the flow chart shown in FIG. 1, the cut-off stage is arranged after the light-emitting stage. In other embodiments of the present disclosure, the cut-off stage may be arranged before the light-emitting stage. The cut-off stage may also be arranged both before the light-emitting stage and after the light-emitting stage. When a plurality of cut-off stages are provided, the drive transistor may operate in the full cut-off region in several stages during a time period for a frame of display, thereby further lowering the voltage bias of the drive transistor, the drift, the non-coincidence and the display mura.

The proportion of the cut-off stage in a time period for a frame of display is greater than zero and less than or equal to 5%. Since the drive transistor operates in the full cut-off region in the cut-off stage, the drive transistor does not generate the drive current to drive the light-emitting element to emit light. Generally, the time period of a frame is fixed. If the duration for the cut-off stage is long, the duration for the light-emitting stage of the light-emitting element may be insufficient, so that a dark state would occur during display. Therefore, the proportion of the cut-off stage in a time period for a frame of display is greater than zero and less than or equal to 5%, thereby lowering the drift on the drive transistor to reduce the display mura, and ensuring the display brightness.

Figure 3:
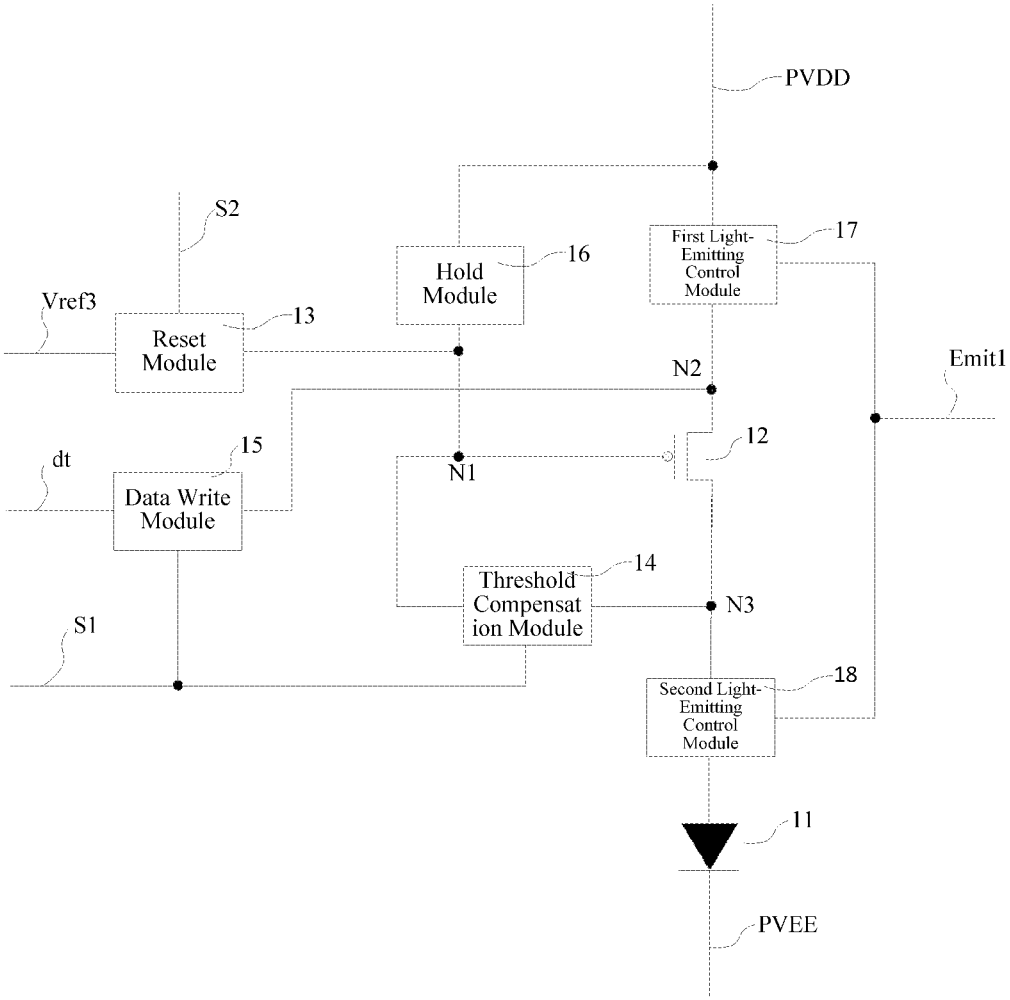
FIG. 3 is an electrical block diagram of a pixel circuit according to an embodiment of the disclosure.

FIG. 3 is a structural diagram of a pixel circuit according to an embodiment of the present disclosure. Referring to FIG. 3, the pixel circuit further includes a light-emitting element 11, a drive transistor 12, a reset module 13, a threshold compensation module 14, a data write module 15, a hold module 16, a first light-emitting control module 17 and a second light-emitting control module 18.

A control terminal of the data write module 15 is electrically connected with a first scan line S1, a first terminal of the data write module 15 is electrically connected with a data line dt, and a second terminal of the data write module 15 is electrically connected with a first electrode of the drive transistor 12 (that is, a second node N2).

A control terminal of the threshold compensation module 14 is electrically connected with the first scan line S1, a first terminal of the threshold compensation module 14 is electrically connected with a second electrode of the drive transistor 12, and a second terminal of the threshold compensation module 14 is electrically connected with the gate electrode of the drive transistor 12.

A first terminal of the hold module 16 is electrically connected with the gate electrode of the drive transistor 12, and a second terminal of the hold module 16 is connected with a first level signal line PVDD.

A control terminal of the first light-emitting control module 17 is electrically connected with a first light-emitting signal line Emit1, a first terminal of the first light-emitting control module 17 is electrically connected with the first level signal line PVDD, and a second terminal of the first light-emitting control module 17 is electrically connected with the first electrode of the drive transistor 12.

A control terminal of the second light-emitting control module is electrically connected with the first light-emitting signal line, a first terminal of the second light-emitting control module 18 is electrically connected with the second electrode of the drive transistor 12, and a second terminal of the second light-emitting control module 18 is electrically connected with a first electrode of the light-emitting element 11.

A control terminal of the reset module 13 is electrically connected with a second scan line S2, a first terminal of the reset module 13 is electrically connected with a third level signal line Vref3, and a second terminal of the reset module 13 is electrically connected with the gate electrode of the drive transistor 12.

A second electrode of the light-emitting element 11 is electrically connected with a second level signal line PVEE.

The drive method provided in the embodiment of the present disclosure further includes a reset stage in which the reset module 13 is turned on so that a reset signal on the third level signal line Vref3 is written into the gate electrode of the drive transistor 12.

In the data writing stage, the reset module 13 is turned off, and the data write module 15 and the threshold compensation module 14 are turned on, so that the voltage associated with the threshold voltage of the drive transistor is stored by the holding module.

In the light-emitting stage, the first light-emitting control module 17 and the second light-emitting control module 18 are turned on, so that the drive current generated by the drive transistor 12 is transmitted to the light-emitting element.

Figure 4:
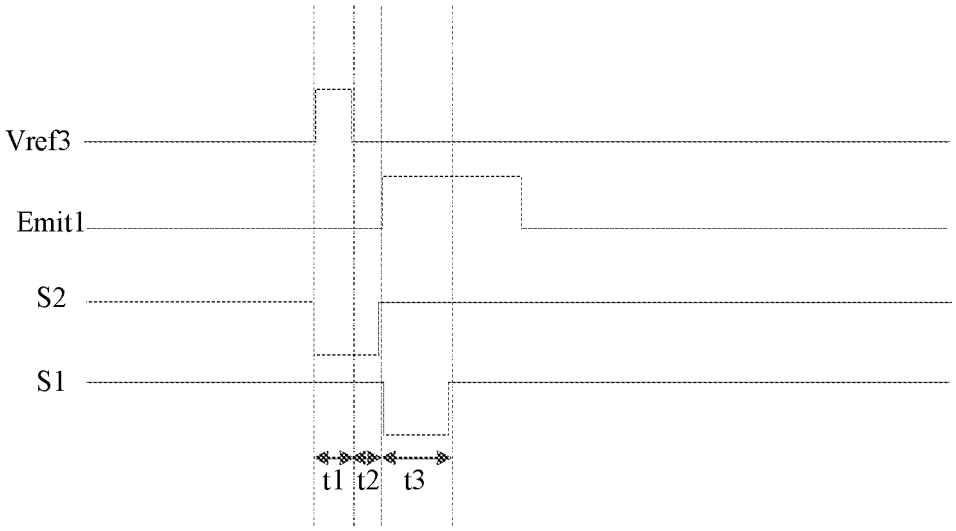
FIG. 4 is a drive timing diagram according to an embodiment of the disclosure.

In one embodiment, FIG. 4 is a driving timing diagram provided by an embodiment of the present disclosure. The specific process of the driving method for the pixel circuit according to the embodiment of the present disclosure is described below with reference to FIGS. 3 and 4.

In the t1 stage, that is the cut-off stage, the light-emitting signal on the light-emitting signal line Emit1 is written into the control terminal of the first light-emitting control module 17 and the control terminal of the second light-emitting control module 18. The first light-emitting control module 17 and the second light-emitting control module 18 are turned on and hence the first level signal on the first level signal line PVDD is written into the gate electrode of the drive transistor 12. The scan signal on the second scan line S2 is written into the control terminal of the reset module 13, so that the reset module 13 is turned on, and the third level signal on the third level signal line Vref3 is written into the gate electrode of the drive transistor 12. It can be seen that the signal on the third level signal line Vref3 is a high level signal which is a cut-off signal. The voltage on the signal on the third level signal line Vref3 and the voltage on the first light-emitting signal line Emit1 enable the drive transistor 12 to operate in the full cut-off region.

In the t2 stage, that is the reset stage, the third level signal on the third level signal line Vref3 is a low level signal which is a reset signal. The voltage on the gate electrode of the drive transistor 12 and the voltage on the first terminal of the hold module 16 are initialized.

In the t3 stage, that is the data writing stage, the reset module 13 is turned off, the scan signal on the first scan line S1 is written into the gate electrode of the threshold compensation module 14, so that the threshold compensation module 14 is turned on. The scan signal on the first scan line S1 is written into the control terminal of the data write module 15, so that the data write module 15 is turned on. The data signal on the data line dt is written into the gate electrode (that is, the first node N1) of the drive transistor 12 through sequentially the data write module 16, the drive transistor 12 and the compensation transistor M10. The voltage on the gate electrode (that is, the voltage of the first node N1) of the drive transistor 12 is gradually increased until the drive transistor 12 is turned off. It is provided that the voltage magnitude of the data signal on the data line dt is $V_{data}$. When the drive transistor 12 is turned off, the voltage on the gate electrode of the drive transistor 12, i.e., the voltage $V_1$ of the first node N1 is equal to $V_{data}+V_{th}$, wherein $V_{th}$ is the threshold voltage of the drive transistor 12.

In a stage after the t3 stage (which is also referred to as a light-emitting stage), the signal on the first scan line S1 is a high level signal. The data write module 15 and the threshold compensation module 14 are turned off, the light-emitting signal on the first light-emitting signal line Emit1 is written into the control terminal of the first light-emitting control module 17 and the control terminal of the second light-emitting control module 18, and the first light-emitting control module 17 and the second light-emitting control module 18 are turned on; a drain current $I_d$ of the drive transistor 12, i.e., the drive current, drives the light-emitting element 11 to emit light through the second light-emitting control module 18, thereby realizing the display function of the display panel. The drive current $I_d$ meets equation 1 below:

$$I_d = \frac{1}{2}\mu C_{ox}\frac{W}{L}(V_{gs}-V_{th})^2 = \frac{1}{2}\mu C_{ox}\frac{W}{L}(V_1-V_{PVDD}-V_{th})^2 = I_d = \frac{1}{2}\mu C_{ox}\frac{W}{L}(V_{gs}-V_{th})^2 = \frac{1}{2}\mu C_{ox}\frac{W}{L}(V_{data}+V_{th}-V_{PVDD}-V_{th})^2 = \frac{1}{2}\mu C_{ox}\frac{W}{L}(V_{data}-V_{PVDD})^2 \quad (1)$$

wherein, μ is the carrier mobility of the drive transistor 12, W, L is the width and length of a channel of the drive transistor 12, $C_{ox}$ is the gate oxide layer capacitance, per unit area, of the drive transistor 12. $V_{PVDD}$ is the voltage magnitude of the first level signal on the first level signal line PVDD, and is also the voltage magnitude of the second node N2. It may be seen that, the drive current $I_d$ generated by the drive transistor 12 is independent of the threshold voltage $V_{th}$ of the drive transistor 12. Therefore, the problem of abnormal display due to the drift on the threshold voltage of the drive transistor 12 may be solved. Moreover, because in the cut-off stage, the drive transistor 12 operates in a full cut-off region, the drift on characteristic of the drive transistor 12 may be lowered, display mura and artifact may be lowered, and the display quality may be improved. FIG. 2 is a contrast chart of characteristic curves of a drive transistor according to an embodiment of the disclosure. Referring to FIG. 2, the first curve 201 may represent the original characteristic curve of the drive transistor, the second curve 202 may represent the characteristic curve of the drive transistor after the characteristic drifts, and the third curve 203 may represent the characteristic curve after threshold compensation is performed on the drive transistor. It may be seen that the third curve 203 still cannot coincide with the first curve 201 even after the threshold compensation. In the full cut-off region, the first curve 201, the second curve 202 and the third curve 203 are highly coincided with each other. In this case, in a time period for a frame of display, the drive transistor 12 is controlled by the control module 15 to operate in a full cut-off region in a part of the time period (the cut-off stage), so that the drift on characteristics of the drive transistor 12 may be lowered, the compensation effect may be improved, thereby further lowering the display mura and artifact, and improving the display effect.

The signal on the third level signal line includes at least one pulse signal, the pulse signal includes a high level stage and a low level stage.

The high level stage is used for the cut-off signal and the low level stage is used for the reset signal, or the high level stage is used for the reset signal, and the low level stage is used for the cut-off signal.

The difference between the voltage value of the high level stage and the voltage value of the first level signal is greater than the negative value of the threshold voltage of the drive transistor, or the difference between the voltage value of the low level stage and the voltage value of the first level signal line is less than the negative value of the threshold voltage of the drive transistor.

Figure 5:
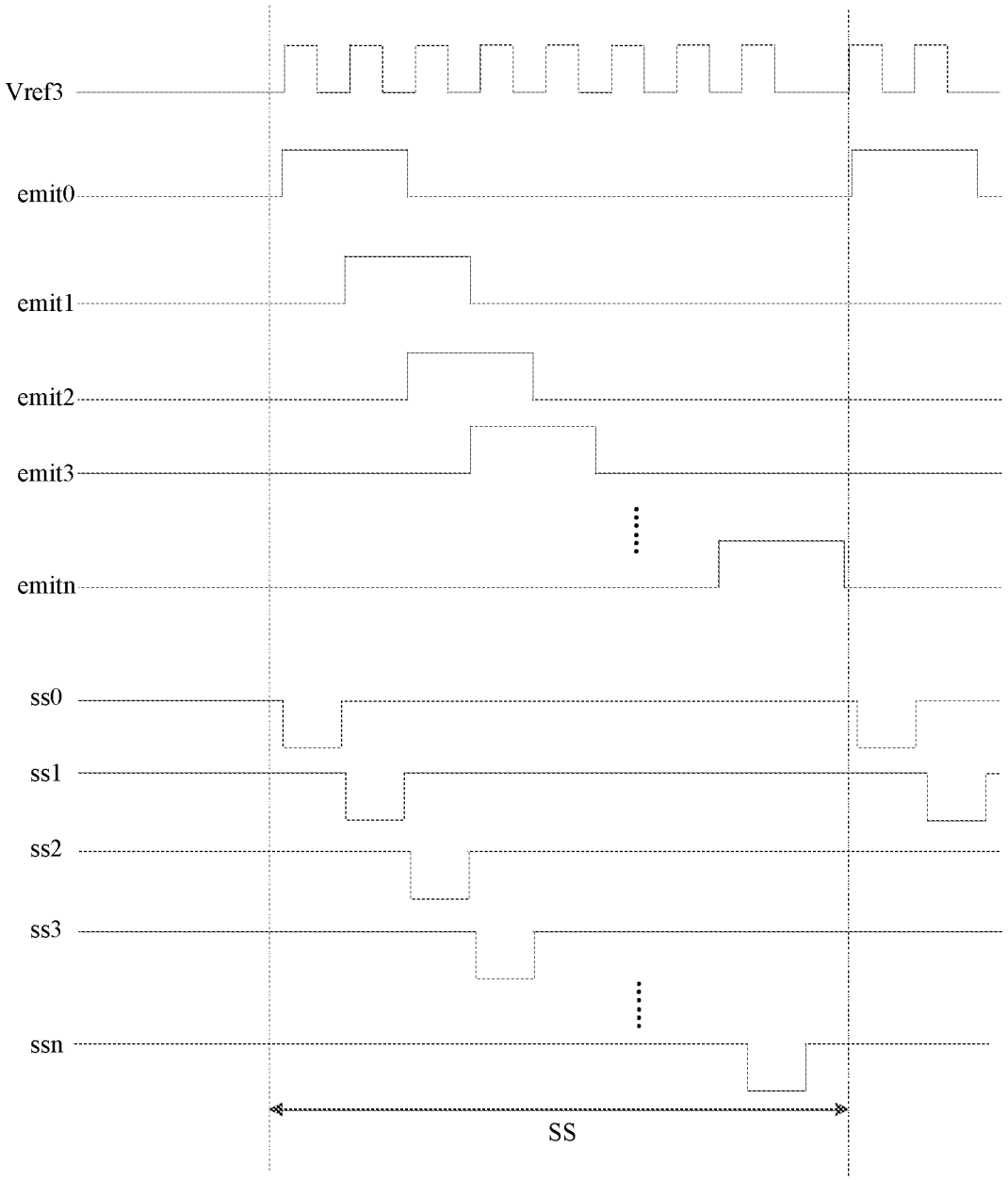
FIG. 5 is another drive timing diagram according to an embodiment of the disclosure.

FIG. 5 is another driving timing chart according to an embodiment of the present disclosure. Referring to FIG. 5, ss1, ss2, . . . and Ssn denote signals on the first row of scan lines, the second row of scan lines, . . . and the n-th row of scan lines, respectively; emit1, emit2, emitn denotes the first row of light-emitting signal lines, the second row of light-emitting signal lines, . . . , and the n-th row of light-emitting signal lines, respectively. Each row of pixel circuits can correspond to a row of scan lines and a row of light-emitting signal lines. It should be noted that the scan lines may be electrically connected to the output terminals of a scan driving circuit, i. e., a gate driving circuit (GOA), on the display panel. The GOA circuit may be located in the non-display region of the display panel, and may be located in one of sides or both sides of the display region of the display panel. The GOA circuit provides a scan signal on a scan line. After the charge is completed, the GOA circuit provides a scan signal on the next scan line, thereby achieving the charge of the scan lines in turn. The light-emitting signal lines may be electrically connected to the output terminals of the light-emitting signal driving circuit (EOA) on the display panel. The EOA circuit may be located in a non-display region of the display panel and may be located on one of sides or both sides of the display region of the display panel. The first scan line is a scan line corresponding to the pixel circuit, and the second scan line is previous to the first scan line. The first light-emitting signal line is a light-emitting signal line corresponding to the pixel circuit. The signal on the first scan line and the signal on the second scan line are both pulse signals, and the signal on the second scan line is previous to the signal on the first scan line. That is, the first scanning signal and the second scanning signal have the same amplitude and different stages.

The signal on the third level signal line further includes a cut-off voltage signal.

During the cut-off stage, the reset module is turned on, and the cut-off voltage signal on the third level signal line is written into the gate electrode of the drive transistor, the first light-emitting control module is turned on, and the first level signal on the first level signal line is written into the first electrode of the driver transistor.

It can be seen that during the turned-on state of the reset module, the cut-off voltage signal and the reset signal are in turn written into the gate electrode of the drive transistor.

Figure 6:
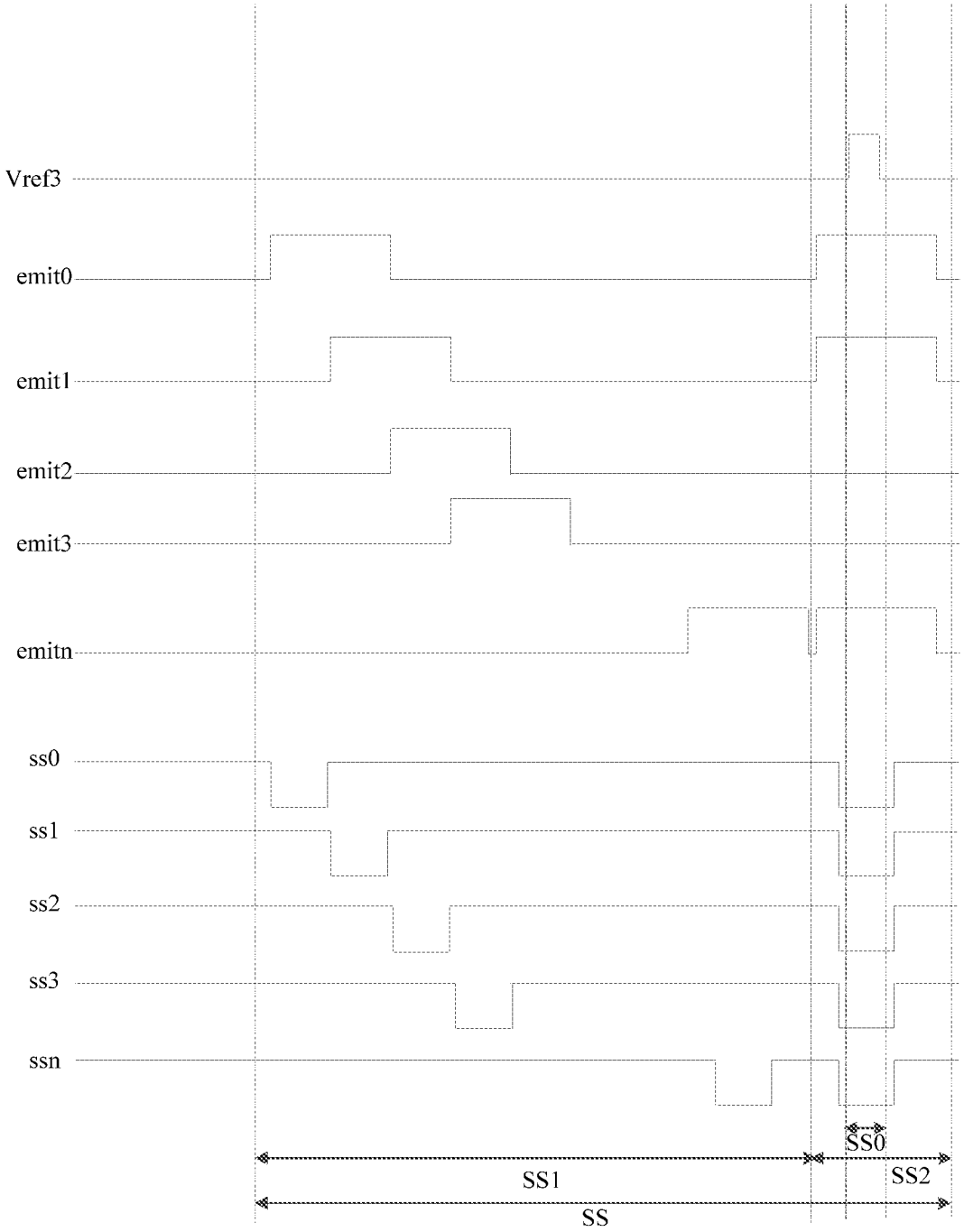
FIG. 6 is another drive timing diagram according to an embodiment of the disclosure.

FIG. 6 is another driving timing diagram according to an embodiment of the present disclosure. It can be seen that the reset stage is arranged before the light-emitting stage, and the cut-off stage SS0 is arranged after the light-emitting stage. In the cut-off stage, the first light-emitting control module and the second light-emitting control module are turned off and the reset module is turned on, and the cut-off voltage signal on the third level signal line is written into the gate electrode of the drive transistor. A time period SS for a frame of display includes a stage SS1 and a stage SS2, and the cut-off stage SS0 is located in the stage SS2.

Further, the cut-off stage SS0 of each row of the pixel circuits is located at the end of a time period SS for a frame of display, and the cut-off stage SS0 of each row of the pixel circuits is located after the light-emitting stage of the last row of the pixel circuits. It is not necessary to design a cut-off stage SS0 for each row of the pixel circuits.

In one embodiment, during the cut-off stage SS0, the light-emitting signal corresponding to the each row of the pixel circuits is at a high level, each of the first light-emitting control module and the second light-emitting control module is turned off, the reset module, the data write module and the threshold compensation module in each row of pixel circuits are all turned on, and the cut-off voltage signal on the third level signal line is written into the gate electrode of the drive transistor of each row of the pixel circuits. Thereby, all rows of pixel circuits operate in the cut-off stage SS0, so that the design of the driving timing is relatively simple.

Figure 7:
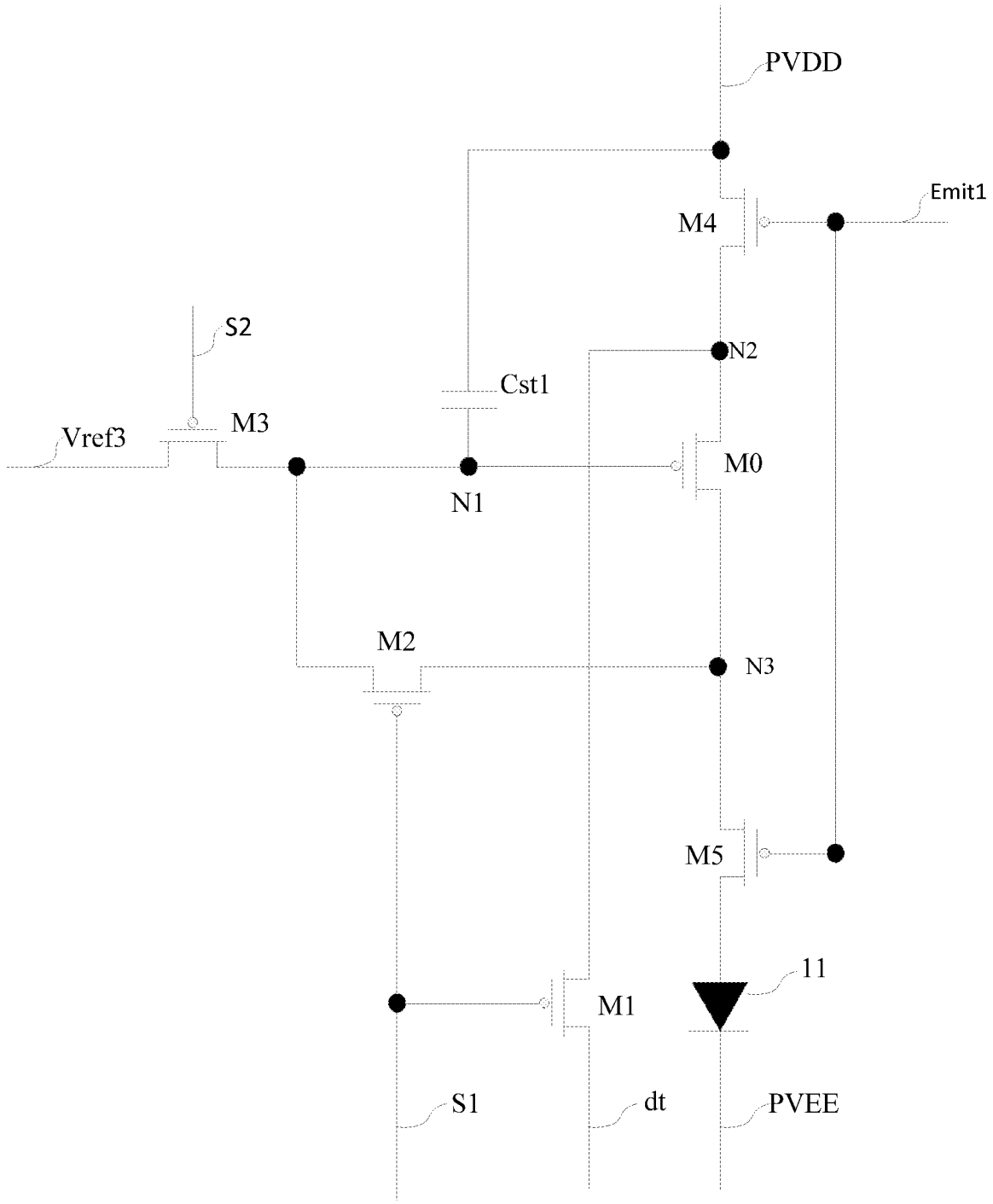
FIG. 7 is an electrical block diagram of another pixel circuit according to an embodiment of the disclosure.

FIG. 7 is a circuit diagram of another pixel circuit according to an embodiment of the present disclosure. Referring to FIG. 7, on the basis of the above embodiment, the data write module includes a first transistor M1, the threshold compensation module includes a second transistor M2, the reset module includes a third transistor M3, the first light-emitting control module includes a fourth transistor M4, the second light-emitting control module includes a fifth transistor M5, and the hold module includes a first capacitor Cst1.

A first electrode of the first transistor M1 is electrically connected to the data line dt, a second electrode of the first transistor M1 is electrically connected to a first electrode of the drive transistor M0, and a gate electrode of the first transistor M1 is electrically connected to the first scan line S1.

A first electrode of the second transistor M2 is electrically connected to a second electrode of the drive transistor M0, a second electrode of the second transistor M2 is electrically connected to the gate electrode of the drive transistor M0, and a gate electrode of the second transistor M2 is electrically connected to the first scan line S1.

A first electrode of the third transistor M3 is electrically connected to the third level signal line Vref3, a second electrode of the third transistor M3 is electrically connected to the gate electrode of the drive transistor M0, and a gate electrode of the third transistor M3 is electrically connected to the second scan line S2.

A first electrode of the fourth transistor M4 is electrically connected to the first level signal line PVDD, a second electrode of the fourth transistor M4 is electrically connected to the first electrode of the drive transistor M0, and a gate electrode of the fourth transistor M4 is electrically connected to the first light-emitting signal line Emit1.

A first electrode of the fifth transistor M5 is electrically connected to the second electrode of the drive transistor M0, a second electrode of the fifth transistor M5 is electrically connected to a first electrode of the light-emitting element 11, and a gate electrode of the fifth transistor M5 is electrically connected to the first light-emitting signal line Emit1.

A first electrode of the first capacitor Cst1 is electrically connected to the gate electrode of the drive transistor M0, a second electrode of the first capacitor Cst1 is electrically connected to the first electrode of the drive transistor M0.

In the cut-off stage, the third transistor M3 is turned on, the cut-off signal on the third level signal line Vref3 is written into the gate electrode of the drive transistor M0, and hence the drive transistor M0 operates in the full cut-off state.

In the reset stage, the third transistor M3 is turned on, the reset signal on the third level signal line Vref3 is written into the first electrode of the first capacitor Cst1, and hence the first capacitor Cst1 is reset.

In the data writing stage, the first transistor M1 and the second transistor M2 are turned on, and hence the first electrode of the first capacitor Cst1 stores a drive voltage associated with the threshold voltage of the drive transistor M0.

In the light-emitting stage, the fourth transistor M4 and the fifth transistor M5 are turned on, and hence the drive current generated by the drive transistor M0 is transmitted to the light-emitting element 11.

In the embodiment of the present disclosure, the first to fifth transistors are all P-type transistors, or the first to fifth transistors are all N-type transistors.

Figure 8:
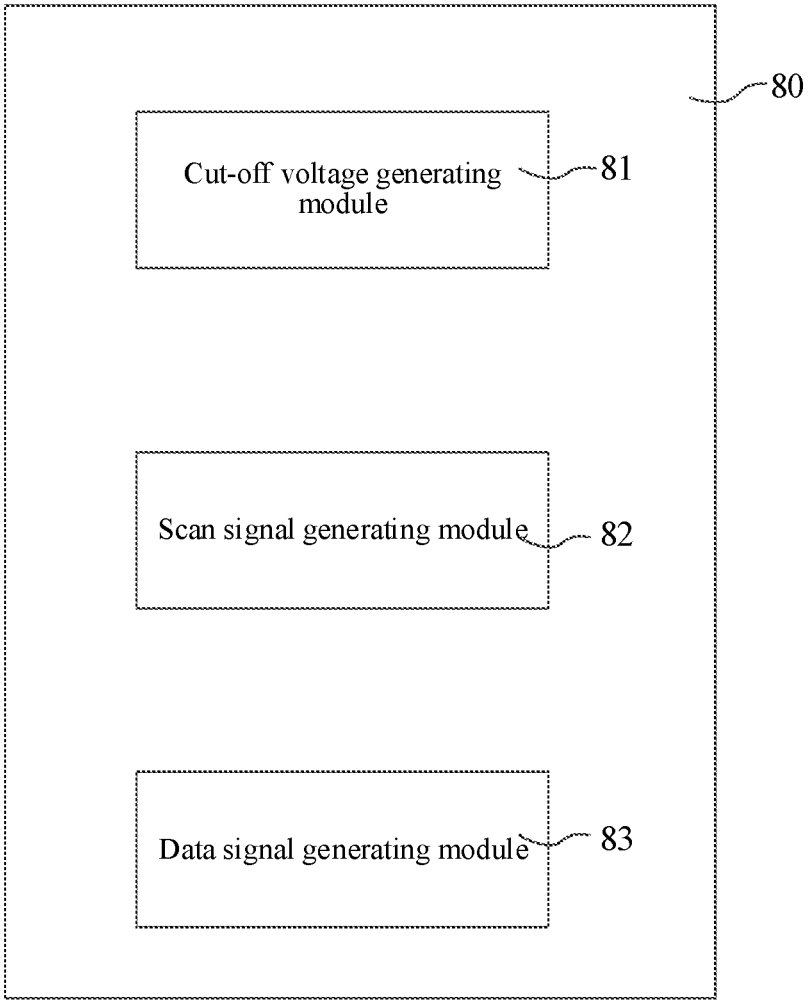
FIG. 8 is a schematic structural diagram of a display panel according to an embodiment of the disclosure.

An embodiment of the present disclosure further provides a display panel. Referring to FIG. 8, FIG. 8 is a schematic structural diagram of a display panel according to an embodiment of the present disclosure. The display panel 80 includes a plurality of pixel circuits arranged in an array. The pixel circuits include a data write module, a drive transistor, a hold module and a light-emitting element.

The display panel 80 further includes:

A cut-off voltage generating module 81 for generating a cut-off voltage and transmitting the cut-off voltage to a gate electrode of the drive transistor, so that the control transistor operates in a full cut-off region.

The scan signal generating module 82 is configured to output the generated scan signal to the scan line to control the data write module to be turned on.

The data signal generating module 83 is configured to generate a data signal corresponding to the image signal and output the data signal to the data line, so that the data signal on the data line is written into the gate electrode of the drive transistor through the turned-on data write module, in order to control the drive transistor to supply a drive current to the light-emitting element so as to drive the light-emitting element to emit light.

The driving method of the pixel circuit according to any of the embodiments of the present disclosure may be applied to the above display panel 80.

Figure 9:
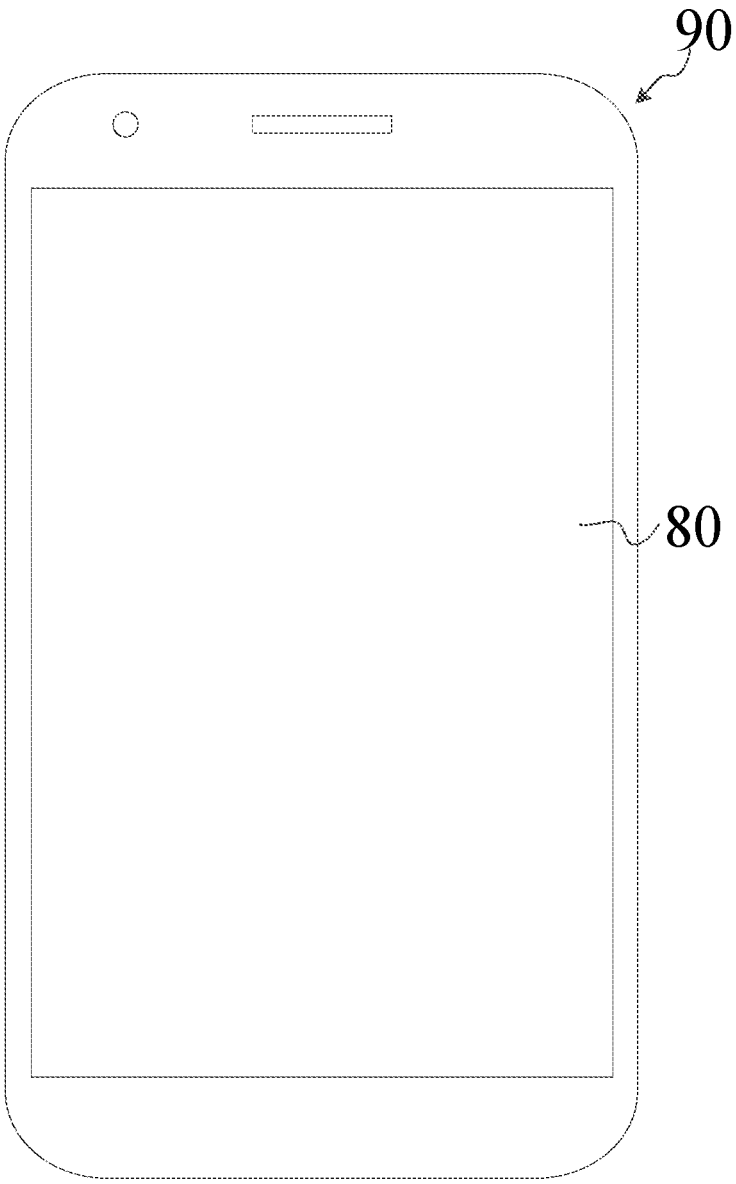
FIG. 9 is a schematic structural diagram of a display device according to an embodiment of the disclosure.

An embodiment of the present disclosure further provides a display device. Referring to FIG. 9, FIG. 9 is a schematic structural diagram of a display device according to an embodiment of the present disclosure. The display device 90 includes the display panel 80 according to any of the embodiments of the present disclosure.

It should be noted that the embodiments of the present disclosure and the technical principles used therein are described as above. It should be appreciated that the disclosure is not limited to the particular embodiments described herein, and any apparent alterations, modification and substitutions can be made without departing from the scope of protection of the disclosure. Accordingly, while the disclosure is described in detail through the above embodiments, the disclosure is not limited to the above embodiments and can further include other additional embodiments without departing from the concept of the disclosure.

What is claimed is:

1. A method for driving a pixel circuit, wherein the pixel circuit comprises: a data write module, a drive transistor, a hold module and a light-emitting element, wherein the drive method comprises, in a time period for a frame of display:

a data writing stage wherein a data signal is written by the data write module into a gate electrode of the drive transistor;

a light-emitting stage wherein a voltage on the gate electrode of the drive transistor is held by the hold module, the drive transistor supplies a drive current to the light-emitting element, and the light-emitting element emits light in response to the drive current; and a cut-off stage wherein the drive transistor operates in a full cut-off region;

wherein the pixel circuit further comprises a threshold compensation module, a reset module, a first light-emitting control module and a second light-emitting control module;

wherein a control terminal of the data write module is electrically connected with a first scan line, a first terminal of the data write module is electrically connected with a data line, and a second terminal of the data write module is electrically connected with a first electrode of the drive transistor;

wherein a control terminal of the threshold compensation module is electrically connected with the first scan line, a first terminal of the threshold compensation module is electrically connected with a second electrode of the drive transistor, and a second terminal of the threshold compensation module is electrically connected with the gate electrode of the drive transistor;

wherein a first terminal of the hold module is electrically connected with the gate electrode of the drive transistor, and a second terminal of the hold module is connected with a first level signal line;

wherein a control terminal of the first light-emitting control module is electrically connected with a first light-emitting signal line, a first terminal of the first light-emitting control module is electrically connected with the first level signal line, and a second terminal of the first light-emitting control module is electrically connected with the first electrode of the drive transistor;

wherein a control terminal of the second light-emitting control module is electrically connected with the first light-emitting signal line, a first terminal of the second light-emitting control module is electrically connected with the second electrode of the drive transistor, and a second terminal of the second light-emitting control module is electrically connected with a first electrode of the light-emitting element;

wherein a control terminal of the reset module is electrically connected with a second scan line, a first terminal of the reset module is electrically connected with a third level signal line, and a second terminal of the reset module is electrically connected with the gate electrode of the drive transistor;

wherein a second electrode of the light-emitting element is electrically connected with a second level signal line;

wherein the method further comprises a reset stage, wherein in the reset stage, the reset module is turned on so that a reset signal on the third level signal line is written into the gate electrode of the drive transistor;

wherein in the data writing stage, the reset module is turned off, and the data write module and the threshold compensation module are turned on, so that the voltage associated with the threshold voltage of the drive transistor is stored by the holding module; and wherein in the light-emitting stage, the first light-emitting control module and the second light-emitting control module are turned on, so that the drive current generated by the drive transistor is transmitted to the light-emitting element.

2. The method for driving a pixel circuit as claimed in claim 1, wherein the drive transistor is one of an N-type transistor and a P-type transistor;

when the drive transistor is an N-type transistor, then in the cut-off stage, a voltage difference between the gate electrode and a source electrode of the drive transistor will be smaller than a negative value of the threshold voltage; or when the drive transistor is a P-type transistor, then in the cut-off stage, the voltage difference between the gate electrode and the source electrode of the drive transistor will be larger than the negative value of the threshold voltage thereof.

3. The method for driving a pixel circuit as in claim 1, wherein the cut-off stage is arranged before the light-emitting stage or after the light-emitting stage.

4. The method for driving a pixel circuit as claimed in claim 1, wherein the proportion of the cut-off stage in a time period for a frame of display is greater than zero and less than or equal to 5%.

5. The method as claimed in claim 1, wherein the signal on the third level signal line further comprises a cut-off voltage signal; and wherein during the cut-off stage, the reset module is turned on, the cut-off voltage signal on the third level signal line is written into the gate electrode of the drive transistor, the first light-emitting control module is turned on, and the first level signal on the first level signal line is written into the first electrode of the driver transistor.

6. The method as claimed in claim 5, wherein during the turned-on state of the reset module, the cut-off voltage signal and the reset signal are in turn written into the gate electrode of the drive transistor.

7. The method as claimed in claim 1, wherein the reset stage is arranged before the light-emitting stage, and the cut-off stage is arranged after the light-emitting stage; and wherein in the cut-off stage, the first light-emitting control module and the second light-emitting control module are turned off and the reset module is turned on, and the cut-off voltage signal on the third level signal line is written into the gate electrode of the drive transistor.

8. The method as claimed in claim 7, wherein the cut-off stage of each row of the pixel circuits is located at the end of a time period for a frame of display, and the cut-off stage of each row of the pixel circuits is arranged after the light-emitting stage of the last row of the pixel circuits.

9. The method as claimed in claim 7, wherein in the cut-off stage, each of the first light-emitting control module and the second light-emitting control module of each row of the pixel circuits is turned off, each of the reset module, the data write module and the threshold compensation module of each row of the pixel circuits is turned on, and the cut-off voltage signal on the third level signal line is written into the gate electrode of the drive transistor of each row of the pixel circuits.

10. The method as claimed in claim 1, wherein the signal on the first scan line and the signal on the second scan line are both pulse signals, and the signal on the second scan line occurs before the signal on the first scan line occurs.

11. The method as claimed in claim 1, wherein the signal on the third level signal line comprises at least one pulse signal, and the pulse signal comprises a high level stage and a low level stage, and wherein the high level stage is used for one of the reset signal and the cut-off signal, and the low level stage is used for the other of the reset signal and the cut-off signal.

12. The method as claimed in claim 11, wherein the difference between the voltage value of the high level stage and the voltage value of the first level signal is greater than the negative value of the threshold voltage of the drive transistor.

13. The method as claimed in claim 1, wherein, the data write module comprises a first transistor, the threshold compensation module comprises a second transistor, the reset module comprises a third transistor, the first light-emitting control module comprises a fourth transistor, the second light-emitting control module comprises a fifth transistor, and the hold module comprises a first capacitor;

wherein a first electrode of the first transistor is electrically connected with the data line, a second electrode of the first transistor is electrically connected with the first electrode of the drive transistor, and a gate electrode of the first transistor is electrically connected with the first scan line;

wherein a first electrode of the second transistor is electrically connected with the second electrode of the drive transistor, a second electrode of the second transistor is electrically connected with the gate electrode of the drive transistor, and a gate electrode of the second transistor is electrically connected with the first scan line;

wherein a first electrode of the third transistor is electrically connected with the third level signal line, a second electrode of the third transistor is electrically connected with the gate electrode of the drive transistor, and a gate electrode of the third transistor is electrically connected with the second scan line;

wherein a first electrode of the fourth transistor is electrically connected with the first level signal line, a second electrode of the fourth transistor is electrically connected with the first electrode of the drive transistor, a gate electrode of the fourth transistor is electrically connected with the first light-emitting signal line;

wherein a first electrode of the fifth transistor is electrically connected with the second electrode of the drive transistor, a second electrode of the fifth transistor is electrically connected with the first electrode of the light-emitting element, and a gate electrode of the fifth transistor is electrically connected with the first light-emitting signal line;

wherein a first electrode of the first capacitor is electrically connected with the gate electrode of the drive transistor, and a second electrode of the first capacitor is electrically connected with the first electrode of the drive transistor;

wherein the method further comprises:

in the cut-off stage, the third transistor is turned on, the cut-off signal on the third level signal line is written into the gate electrode of the drive transistor, and hence the drive transistor operates in the full cut-off state, in the reset stage, the third transistor is turned on, the reset signal on the third level signal line is written into the first electrode of the first capacitor, and hence the first capacitor is reset, in the data writing stage, the first transistor and the second transistor are turned on, and hence the first electrode of the first capacitor stores a drive voltage associated with the threshold voltage of the drive transistor, and in the light-emitting stage, the fourth transistor and the fifth transistor are turned on, and hence the drive current generated by the drive transistor is transmitted to the light-emitting element.

14. The method as claimed in claim 13, wherein each of the first transistor, the second transistor, the third transistor, the fourth transistor and the fifth transistor is one of a P-type transistor and a N-type transistor.

15. The method as claimed in claim 11, wherein the difference between the voltage value of the low level stage and the voltage value of the first level signal line is less than the negative value of the threshold voltage of the drive transistor.

16. A display panel, comprising pixel circuits arranged in an array, wherein the pixel circuit comprises a data write module, a drive transistor, a hold module and a light-emitting element;

wherein the display panel further comprises:

a cut-off voltage generating circuit, configured to generate a cut-off voltage and transmit the cut-off voltage to a gate electrode of the drive transistor, so as to control the drive transistor to operate in a full cut-off region;

a scan signal generating circuit, configured to output the generated scan signal to a scan line to control the data write module to be turned on; and a data signal generating circuit configured to generate a data signal corresponding to an image signal and output the data signal to a data line so that the data signal on the data line is written into the gate electrode of the drive transistor through the turned-on data write module, in order to control the drive transistor to supply a drive current to the light-emitting element for driving the light-emitting element to emit light;

wherein the pixel circuit further comprises a threshold compensation module, a reset module, a first light-emitting control module and a second light-emitting control module;

wherein a control terminal of the data write module is electrically connected with a first scan line, a first terminal of the data write module is electrically connected with a data line, and a second terminal of the data write module is electrically connected with a first electrode of the drive transistor;

wherein a control terminal of the threshold compensation module is electrically connected with the first scan line, a first terminal of the threshold compensation module is electrically connected with a second electrode of the drive transistor, and a second terminal of the threshold compensation module is electrically connected with the gate electrode of the drive transistor;

wherein a first terminal of the hold module is electrically connected with the gate electrode of the drive transistor, and a second terminal of the hold module is connected with a first level signal line;

wherein a control terminal of the first light-emitting control module is electrically connected with a first light-emitting signal line, a first terminal of the first light-emitting control module is electrically connected with the first level signal line, and a second terminal of the first light-emitting control module is electrically connected with the first electrode of the drive transistor;

wherein a control terminal of the second light-emitting control module is electrically connected with the first light-emitting signal line, a first terminal of the second light-emitting control module is electrically connected with the second electrode of the drive transistor, and a second terminal of the second light-emitting control module is electrically connected with a first electrode of the light-emitting element;

wherein a control terminal of the reset module is electrically connected with a second scan line, a first terminal of the reset module is electrically connected with a third level signal line, and a second terminal of the reset module is electrically connected with the gate electrode of the drive transistor; and wherein a second electrode of the light-emitting element is electrically connected with a second level signal line.

17. A display device, comprising the display panel as claimed in claim 16.

* * * * *